US009235946B2

(12) United States Patent
Wu

(10) Patent No.: US 9,235,946 B2
(45) Date of Patent: Jan. 12, 2016

(54) COIN DEPOSIT AND SUMMATION MEMORY DEVICE

(71) Applicant: Huannan Wu, Fujian (CN)

(72) Inventor: Huannan Wu, Fujian (CN)

( * ) Notice: Subject to any disclaimer, the term of this patent is extended or adjusted under 35 U.S.C. 154(b) by 0 days.

(21) Appl. No.: 14/645,396

(22) Filed: Mar. 11, 2015

(65) Prior Publication Data

US 2015/0187156 A1 Jul. 2, 2015

Related U.S. Application Data

(63) Continuation-in-part of application No. PCT/CN2013/085889, filed on Oct. 24, 2013.

(30) Foreign Application Priority Data

Dec. 25, 2012 (CN) ..... 2012 1 0569640
Mar. 15, 2013 (CN) ..... 2013 1 0083322

(51) Int. Cl.

| | |
|---|---|
| ***G06M 3/10*** | (2006.01) |
| ***G07D 3/16*** | (2006.01) |
| ***G07F 5/20*** | (2006.01) |
| ***G07D 9/04*** | (2006.01) |
| ***G07D 3/00*** | (2006.01) |
| ***G07D 5/02*** | (2006.01) |

(52) U.S. Cl.

CPC .. *G07D 3/16* (2013.01); *G07D 3/00* (2013.01); *G07D 5/02* (2013.01); *G07D 9/04* (2013.01); *G07F 5/20* (2013.01)

(58) Field of Classification Search

CPC ..... G07F 17/24; G07F 5/08; G07F 5/18; G07F 5/22; G07F 5/20; G07F 5/24; G07F 5/12; G07F 17/248; G07F 5/02; G07F 11/002; G07F 13/02; G07F 17/045; G07F 9/08; G07F 17/105; G07F 5/04; G07D 9/04; G07D 9/08; G07D 5/02; G07D 3/00; G07D 3/16; A63H 33/3005; A45C 1/12; F16D 7/08; G06M 3/10

USPC ..... 194/223, 227, 228, 270, 272, 276; 235/100; 453/1, 2, 58

See application file for complete search history.

(56) References Cited

U.S. PATENT DOCUMENTS

| | | | | | |
|---|---|---|---|---|---|
| 1,806,892 | A | * | 5/1931 | Connell | 235/100 |
| 1,816,347 | A | * | 7/1931 | Smith | 194/293 |
| 2,523,516 | A | * | 9/1950 | Potter | 377/7 |
| 3,022,938 | A | * | 2/1962 | Rosapepe | 235/42 |
| 3,191,738 | A | * | 6/1965 | New | 194/221 |
| 3,208,572 | A | * | 9/1965 | Jensen | 194/221 |
| 3,333,769 | A | * | 8/1967 | Osborne | 235/100 |
| 3,339,839 | A | * | 9/1967 | Jensen et al. | 235/100 |
| 3,732,875 | A | * | 5/1973 | Jensen et al. | 194/223 |
| 3,762,526 | A | * | 10/1973 | Kiefer | 194/222 |
| 3,974,962 | A | * | 8/1976 | Sulzer | 235/132 R |
| 4,366,375 | A | * | 12/1982 | Crosman | 235/100 |
| 4,667,689 | A | * | 5/1987 | Kohashi | 453/58 |

* cited by examiner

*Primary Examiner* — Jeffrey Shapiro

(57) ABSTRACT

A coin deposit and summation device having a coin denomination identification mechanism and a coin denomination summation mechanism. The device determines different mechanical movement paths according to different diameters of different coin denominations, with each mechanical movement path resulting in a mechanical trigger corresponding to the identified coin denomination; each resulting mechanical trigger drives a mechanical counter wheel to perform denomination summation once according to the identified coin denomination. The device can be designed to achieve denomination identification and summation of 0.5, 0.25 and 0.2 dollar coins.

10 Claims, 13 Drawing Sheets

COIN DEPOSIT AND SUMMATION MEMORY DEVICE

BACKGROUND OF THE INVENTION

The present invention discloses a coin deposit and summation device that belongs to the coin deposit technical field according to the International Patent Classification (IPC), particularly a mechanical coin denomination summation device that is applied to a moneybox or other products for deposit and storage. The present invention can be designed such that it is applicable to the deposit and summation of even 0.5 dollar coins, 0.25 dollar coins and 0.2 dollar coins.

A traditional moneybox is a coin container that receives coins through a coin slot. However, a user of the moneybox does not know how many coins have been put into the moneybox. A deposit device has appeared on the market comprising a counter for the number of coins. Because of different coin denominations, such as 1-dime coins, 5-dime coins and 1-dollar coins, the above device can only count the total number of the deposited coins, but cannot distinguish between denominations and thus cannot do the summation according to denominations. Besides, the existing counter for the number of coins, generally using decimal summation, cannot do the 0.5-unit summation. Although an electronically operated moneybox is able to achieve the denomination summation function, it needs an electric circuit and has to consume electric energy, and cannot be used without electricity, further, an electronically operated moneybox is not friendly to a low carbon environment since its battery has to be dumped and replaced when it is depleted.

Chinese patent publication CN2733469Y discloses an intelligent counting moneybox comprising an upper cover, a counting component, a dialing component, a casing component and a bottom cover component, which can both count while the coins are deposited and open the door automatically after the deposited coins reach a certain amount. Chinese patent publication CN201163424Y discloses a coin deposit accumulator, in which when each time a coin is deposited, the drive component will drive the corresponding counting roulette to rotate once, and meanwhile a group of digits displayed on the display window will be added up once, thereby achieving the summation and display function for the coins. However, the solutions disclosed by the above two literatures are just summation of quantity, without solving the problem of denomination summation.

BRIEF SUMMARY OF THE INVENTION

In view of the shortcomings of the prior arts, the present invention provides a mechanical coin deposit and summation device having a reasonable structure. It is a device which can determine denomination of a coin and perform summation according to the coin diameter.

In order to attain the above purpose, the present invention adopts the following technical solutions:

The first solution: A coin deposit and summation device is provided, comprising a coin denomination identification mechanism and a coin denomination summation mechanism, wherein:

the coin denomination identification mechanism includes a frame provided at an end with a coin slot, which has a moveable end to adapt to different diameters of deposited coins; the moveable end is provided with a mover having a drive needle, with the mover moving along a composite slash track and cooperating with a sorting gate to perform sorting operation on different denominations of coins; the sorting gate has more than one channel respectively corresponding to different denominations of coins, with each of the channels provided with a drive rod that is capable of interacting with the drive needle entering the channel to thereby generate a mechanical trigger corresponding to the coin denomination identified; and the coin denomination summation mechanism includes a set of one-way rotary counter wheels, with the counter wheels for ones and tens positions provided with a one-way drive ratchet respectively; the drive ratchet is connected with a drive mechanism to receive the mechanical trigger sent from the coin denomination identification mechanism and correspondingly drives the corresponding counter wheel to achieve coin denomination summation.

Furthermore, the moveable end is a moveable fender, which is capable of reciprocating along the direction of which the coin slot is oriented and is provided with a vertical chute for receiving the mover; the moveable end, while moving horizontally and linearly, drives the mover to move vertically, with the mover also having interaction with a slope spring leaf and a compression spring so that it can move along the composite slash track; the movement of the mover is also restricted by the sorting gate, with each of the channels of the sorting gate having a blocking gate; with a blocking length of each blocking gate along a linear moving direction of the moveable fender corresponding to a specific diameter of a coin of a specific denomination, coins of different diameters cause the moveable end to move by different distances, making the mover jump in translation so that the drive needle is capable of entering different channels to achieve the coin denomination identification.

Furthermore, the blocking gates in the sorting gate are arranged based on the blocking lengths from small to large, which causes the drive needle to pass the blocking length from small to large during translation from small to large.

Furthermore, the moveable fender is connected on both ends with the frame through tension springs to reset after the coin is deposited, with the moveable end producing a maximum translation corresponding to the coin diameter in the process of the coin passing the coin slot; the drive needle of the mover in the fender enters different channels after the maximum jump translation, and then acts on a drive rod slope and is in linkage to the coin denomination summation mechanism to achieve the coin denomination summation as it returns from the channel; the drive needle gets separated when reaching the end of the drive rod slope, and moves back to the initial position under the action of the compression spring.

Furthermore, the drive mechanism, as a gear engaging mechanism, comprises a sector gear set, wherein each sector gear has a trigger end that is capable of interacting with the drive rod to receive the mechanical trigger, and tooth portion of the sector gear is engaged with an outer gear on the side of the counter wheel and drives the counter wheel to achieve the coin denomination summation.

Furthermore, the coin denomination summation mechanism includes a set of one-way rotary counter wheels, each of the counter wheels being marked on its annular ring with a scale comprising a group of digits for indicating denomination of the deposited coin; the counter wheels for ones and tens positions are each provided with a one-way drive ratchet, and each of other counter wheels is provided inside with a one-way positioning ratchet; a mechanical trigger from the coin denomination identification mechanism acts on an outer gear of the drive ratchet of the ones or tens position through the drive mechanism and drives the counter wheel to rotate; each of the counter wheels is provided on the right periphery with several count linkage teeth and on the left periphery with a linkage tooth for digit carrying, with a linkage wheel provided between the adjacent counter wheels for carrying digit:

a counter wheel for ones position, used for summation of 1-dime coins, driven by one drive rod, and carrying a digit forward to the counter wheel for tens position in every count of 10 digits; and a counter wheel for tens position, used for summation of 5-dime and 10-dime (1-dollar) coins, driven by two drive rods, the counter wheel for tens position counts a whole digit or half a digit in each count; a digit is carried forward to the counter wheel for hundreds position for every ten digits counted in the tens position, or a digit is carried forward to the counter wheel for hundreds position in two times in which half a digit is first carried forward to the counter wheel for hundreds position when reaching a count of nine and a half digits in the tens position, and another half a digit is then carried forward to the counter wheel for hundreds position when there is a subsequent count of half a digit.

Furthermore, the sector gear set comprises a first drive wheel and a second compound wheel, both of which are biased on one side to the initial position; the first drive wheel is capable of interacting with a drive rod and is in linkage with the counter wheel for ones position, delivering one kind of mechanical trigger; the second compound wheel is capable of interacting with two drive rods and is in linkage with the counter wheel for tens position, delivering two kinds of mechanical triggers; the second compound wheel is composed of an active wheel and a passive sector wheel, the active wheel being provided with a reset connection hole for connecting a connecting rod and a spring and being elastically fixed in the initial position, the passive sector wheel being in differential drive with the active wheel, the drive rod sending a mechanical trigger to the active wheel; the active wheel, when rotating differently compared with the passive sector wheel, delivers a mechanical trigger, which acts on a clutch frame to separate a linkage wheel; the active wheel, after differential rotation relative to the passive wheel, gets in linkage with the passive sector wheel, which then engages and is in linkage with the drive ratchet on the counter wheel.

Furthermore, the linkage wheel between the counter wheels for ones and tens positions is mounted on the clutch frame, which is positioned on a base by the elastic member and controlled by the active wheel of the second compound wheel, with the linkage wheel between the counter wheels of ones and tens positions separated from the counter wheel of ones and tens positions to avoid interference with the counter wheel for ones position.

The second solution: A coin deposit and summation device is provided, comprising a coin denomination identification mechanism and a coin denomination summation mechanism, wherein:

the coin denomination identification mechanism includes a frame provided at an end with a coin slot, which has a moveable end to adapt to different diameters of deposited coins; the moveable end is provided with a mover having a drive needle, with the mover moving along a composite slash track and cooperating with a sorting gate to perform sorting operation on different denominations of coins; the sorting gate has more than one channel respectively corresponding to different denominations of coins, with each of the channels provided with a drive rod that is capable of interacting with the drive needle entering the channel to thereby generate a mechanical trigger corresponding to the coin denomination being identified; and the coin denomination summation mechanism includes a set of one-way rotary counter wheels, with the counter wheels for ones, tens and hundreds positions provided with a one-way drive ratchet respectively; the drive ratchet is connected with a drive mechanism to receive the mechanical trigger sent from the coin denomination identification mechanism and correspondingly drives the corresponding counter wheel to achieve coin denomination summation.

Furthermore, the moveable end is a moveable fender, which is capable of reciprocating along the direction of which the coin slot is oriented and is provided with a vertical chute for receiving the mover; the moveable end, while moving horizontally and linearly, drives the mover to move vertically, with the mover also having interaction with a slope spring and a compression spring so that it can move along the composite slash track; the movement of the mover is also restricted by the sorting gate, with each of the channels of the sorting gate having a blocking gate; with a blocking length of each blocking gate along a linear moving direction of the moveable fender corresponding to a specific diameter of a coin of a specific denomination, coins of different diameters cause the moveable end to move linearly by different distances, making the mover jump in translation so that the drive needle is capable of entering different channels to achieve the coin denomination identification.

Furthermore, the blocking gates in the sorting gate are arranged based on the blocking lengths from small to large, so that the drive needle is capable of passing the blocking lengths from small to large during translation from small to large.

Furthermore, the moveable fender is connected on both ends with the frame through tension springs for reset after the coin is deposited, with the moveable end producing a maximum translation corresponding to the coin diameter in the process of the coin passing the coin slot; the drive needle of the mover in the fender enters different channels after the maximum jump translation, and then acts on a drive rod slope and is in linkage to the coin denomination summation mechanism as it returns from the channel to achieve the coin denomination summation; the drive needle is separated from the channel when reaching the end of the drive rod slope, and then moves back to the initial position under the action of the compression spring.

Furthermore, the drive mechanism, as a gear engaging mechanism, comprises a sector gear set, wherein each sector gear has a trigger end that is capable of interacting with the drive rod to receive a mechanical trigger, and tooth portion of the sector gear is engaged with an outer gear on the side of the counter wheel and drives the counter wheel to achieve the coin denomination summation.

Furthermore, there is a scale on each of the counter wheels comprising a group of digits for indicating denomination summation of the deposited coins, the counter wheels for ones, tens and hundreds positions being provided with a one-way drive ratchet respectively; the mechanical trigger from the coin denomination identification mechanism acts on an outer gear of the drive ratchet of ones, tens or hundreds position through the drive mechanism and drives the counter wheel to rotate; each of the counter wheels is provided on the right periphery with several count linkage teeth and on the left side with a linkage tooth for digit carrying, with a linkage wheel provided between the adjacent counter wheels for carrying digit:

a counter wheel for ones position, used for summation of 1-cent coins, driven by one drive rod, carrying a digit forward to the counter wheel for tens position in every counts of 10 digits;

a counter wheel for tens position, used for summation of 5-cent, 1-dime and 25-cent coins, driven by three drive rods, a digit is carried forward to the counter wheel for hundreds position for every ten digits counted in the tens position, or a digit is carried forward to the counter wheel for hundreds position in two times in which half a digit is first carried forward to the counter wheel for hundreds position when reaching a count of nine and a half digits in the tens position, and another half a digit is then carried forward to the counter wheel for hundreds position when there is a subsequent count of half a digit; and a counter wheel for hundreds position, used for summation of 5-dime and 1-dollar coins, driven by two drive rods, carrying a digit forward to a counter wheel for thousands position in the same manner as how a digit is carried forward from the counter wheel for tens position to the counter wheel for hundreds position.

Furthermore, the sector gear set comprises a first drive wheel, a second compound wheel, and a third compound wheel, three of which are biased on one side to the initial position; the first drive wheel is capable of interacting with a drive rod and is in linkage with the counter wheel for ones position, delivering one kind of mechanical trigger; the second compound wheel is capable of interacting with three drive rods and is in linkage with the counter wheel for tens position, delivering three kinds of mechanical triggers; the third compound wheel is capable of interacting with two drive rods and is in linkage with the counter wheel for hundreds position, delivering two kinds of mechanical triggers.

Furthermore, the first drive wheel, the second compound wheel and the third compound wheel each comprises an active wheel and a passive sector wheel; the active wheel is provided with a torsion spring and is elastically fixed in the initial position, with one end of the torsion spring abutting against a first column; the drive rod has mechanical action on the active wheel, which is provided with a lug; wherein the lug on the active wheel of the first drive wheel is inserted into a mounting hole of the passive sector wheel of the first drive wheel, the lug on the active wheel of the second compound wheel is located in a differential hole of the passive sector wheel of the second compound wheel, and the lug on the active wheel of the third compound wheel is located in a differential hole of the passive sector wheel of the third compound wheel, with the lug on each of the active wheel of the second compound wheel and the third compound wheel being able to be relatively displaced in the differential hole, thus achieving differential drive with the passive sector wheel; the active wheel of each of the second compound wheel and the third compound wheel, in the process of rotation difference with the passive sector wheel, delivers a mechanical trigger, which acts on a clutch frame of the linkage wheel to separate the linkage wheel from the counter wheels; the active wheel, after differential rotation relative to the passive wheel, gets in linkage with the passive sector wheel, which then engages and is in linkage with the drive ratchet on the counter wheel.

Furthermore, the linkage wheels between the counter wheels are mounted on the clutch frame, with the clutch frame positioned by the elastic member; the active wheel of the second compound wheel controls the clutch frame to which the linkage wheel between the counter wheels for ones and tens positions corresponds, and the active wheel of the third compound wheel controls the clutch frame to which the linkage wheel between the counter wheels for tens and hundreds positions corresponds, making the linkage wheels separated from the corresponding counter wheels to avoid interference.

Furthermore, the clutch frame is provided with a positioning elastic sheet, one end of which acts on the tooth position of the linkage wheel; the coin denomination summation mechanism also comprises a one-way clipping spring leaf, whose spring leaf cooperates in positioning with the count linkage tooth on the right periphery of the counter wheel.

Furthermore, the sorting gate is provided above with an upper cover plate, which is provided with blocking gates that correspond to the blocking gates of the sorting gate so as to make the mover subjected to a force symmetrically; the coin denomination identification mechanism and the coin denomination summation mechanism are disposed on a chassis.

In the above two solutions, the coin deposit and summation device can achieve denomination identification and summation of 0.5 dollar coins, 0.25 dollar coins and 0.2 dollar coins.

The counting of 0.5 dollar coins is achieved as follows in the present invention: The counter wheel rotates 20 times per one complete rotation by rotating 18 degrees each time, i.e. rotating 18 degrees×20 (360 degrees) in one complete rotation; the scale on the counter wheel has a 0.5 increment and each 18-degree rotation results in one 0.5 increment; therefore there are 20 times of 0.5 increment in one complete rotation of the counter wheel.

Of course, a one whole digit of two times 0.5 can be counted. Counting of a whole digit (1 dollar coins) is done as follows: The counter wheel rotates 10 times per one complete rotation by rotating 36 degrees each time, i.e. rotating 36 degrees×10 (360 degrees) in one complete rotation; the scale on the counter wheel comprises integral digits of 0 to 9, therefore there are 10 digits to be counted in one complete rotation.

The present invention has the following principle of operation: The present invention, determines different mechanical movement paths according to different diameters of different coin denominations, with each mechanical movement path resulting in a mechanical trigger corresponding to the identified coin denomination; each resulting mechanical trigger drives a mechanical counter wheel to perform denomination summation once according to the identified coin denomination.

The present invention has the following beneficial effects:

1. The present invention is purely mechanical, thereby being friendly to a low carbon environment.

2. The present invention achieves denomination summation.

3. The present invention solves the problem of using a coin slot to identify different denominations of coins repeatedly when coins are deposited through the coin slot, and then sum up the denominations of the identified coins.

4. The present invention provides summation of coin denominations which are less than a unit. For example, 0.5 unit, being the smallest unit for a counter wheel that will carry a digit forward in every counts of 20, may exist for denomination summation of US 5-dime (0.5 US dollar) coins; 0.25 unit, being the smallest unit for a counter wheel that will carry a digit forward in every counts of 40, may exist for denomination summation of US 25-cent (0.25 US dollar) coins; 0.20 unit, being the smallest unit for a counter wheel that will carry a digit forward in every counts of 50, may exist for denomination summation of euro 20-cent (0.2 euro) coins.

DETAILED DESCRIPTION OF THE INVENTION

Figure 1:
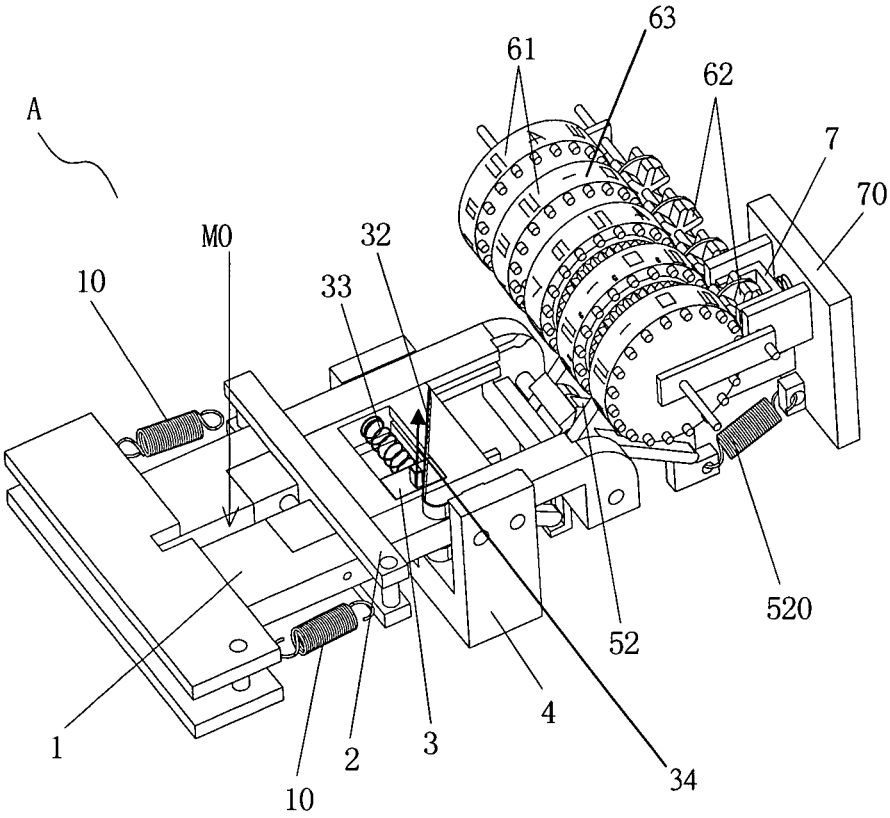
FIG. 1 is a schematic drawing of the coin deposit and summation device according to the first embodiment of the present invention.

The present invention will be further described below with reference to the drawings.

Embodiment 1

As shown in FIGS. 1 to 5, a coin deposit and summation device is provided, comprising a coin denomination identification mechanism A and a coin denomination summation mechanism B, wherein:

the coin denomination identification mechanism A includes a frame 1; an end of the frame 1 is provided with a coin slot MO, which has a moveable end (a moveable frame 2) to adapt to different diameters of deposited coins; the moveable end is provided with a mover 3 having a drive needle 30, with the mover 3 moving along a composite slash track 34 and cooperating with a sorting gate 4 to perform sorting operation on different denominations of coins; the sorting gate 4 has more than one channel 42 respectively corresponding to different denominations of coins, with each of the channels provided with a drive rod that may interact with the drive needle 30 entered thereto to thereby send a mechanical trigger to the coin denomination summation mechanism B based on the corresponding coin denomination being sorted and identified.

The coin denomination summation mechanism B includes a set of one-way rotary counter wheels 61, with the counter wheels for ones position and tens position provided with a one-way drive ratchet 67 respectively; the drive ratchets are connected with a drive mechanism 5 to receive the mechanical trigger sent from the coin denomination identification mechanism A and correspondingly drives their corresponding counter wheels to achieve coin denomination summation.

Figure 2:
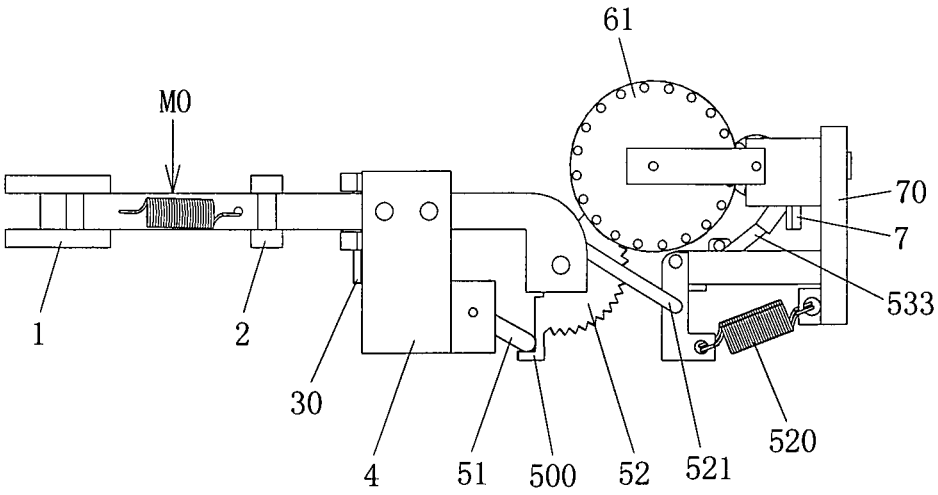
FIG. 2 is a side view of FIG. 1.
Figure 3:
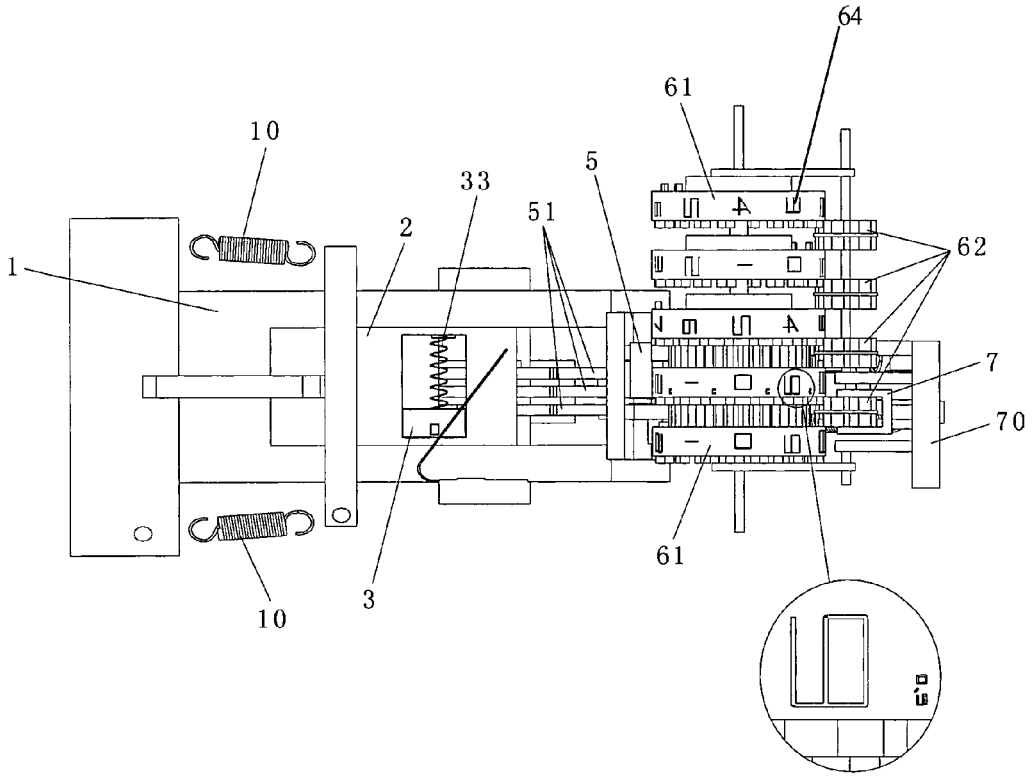
FIG. 3 is a top view of FIG. 1.
Figure 4:
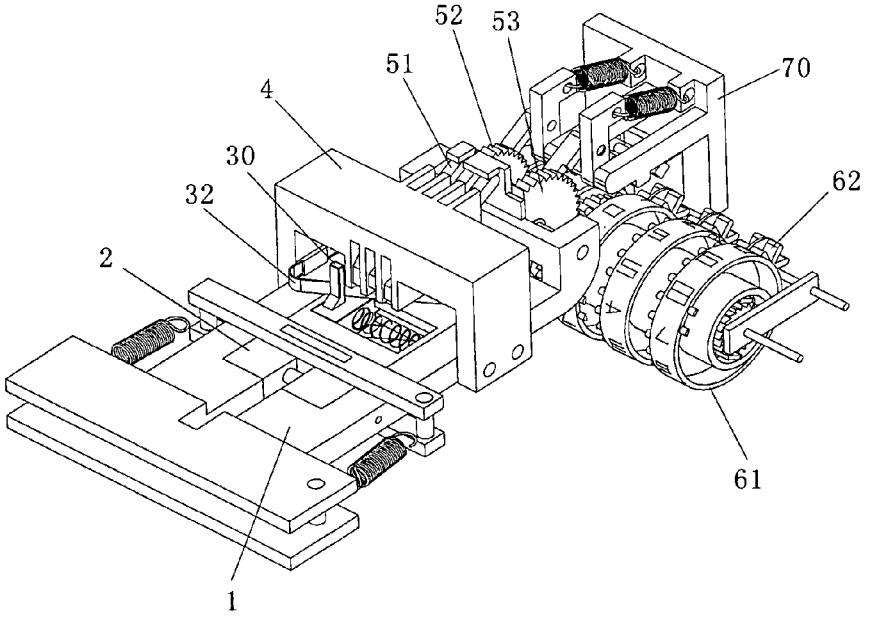
FIG. 4 is another schematic drawing of the coin deposit and summation device according to the first embodiment of the present invention.
Figure 5:
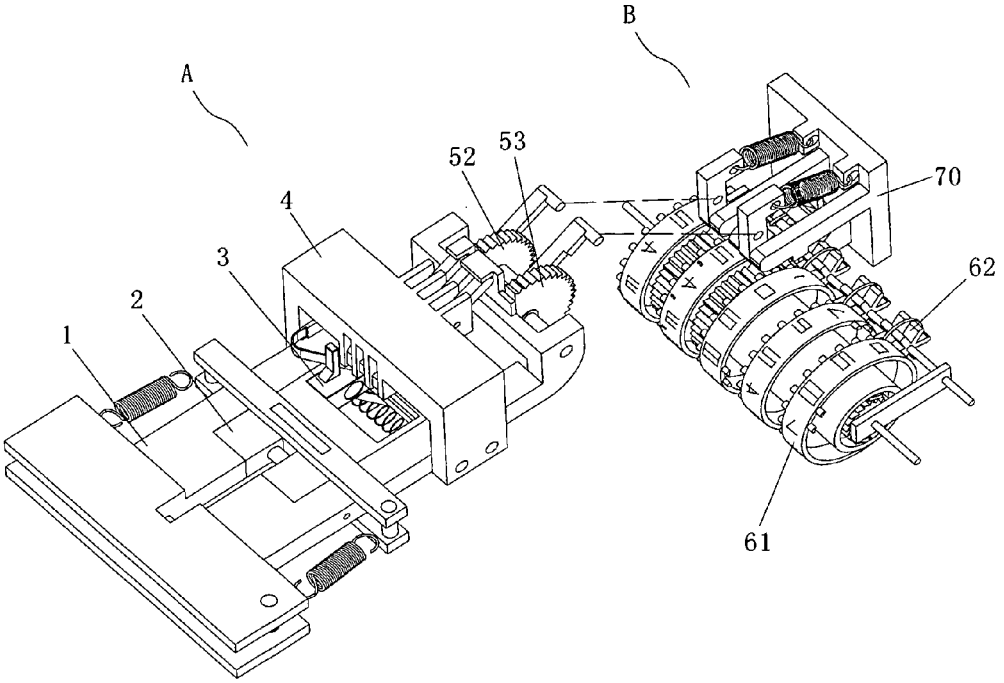
FIG. 5 is a schematic drawing of the first embodiment of the present invention, wherein the coin denomination identification mechanism and the coin denomination summation mechanism are separated.
Figure 6:
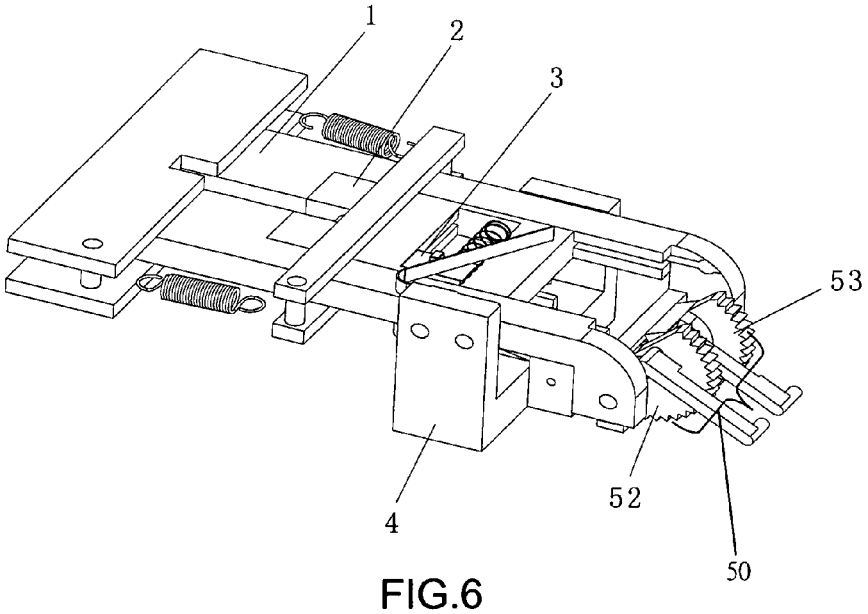
FIG. 6 is a schematic drawing of the coin denomination identification mechanism of the first embodiment of the present invention.
Figure 7:
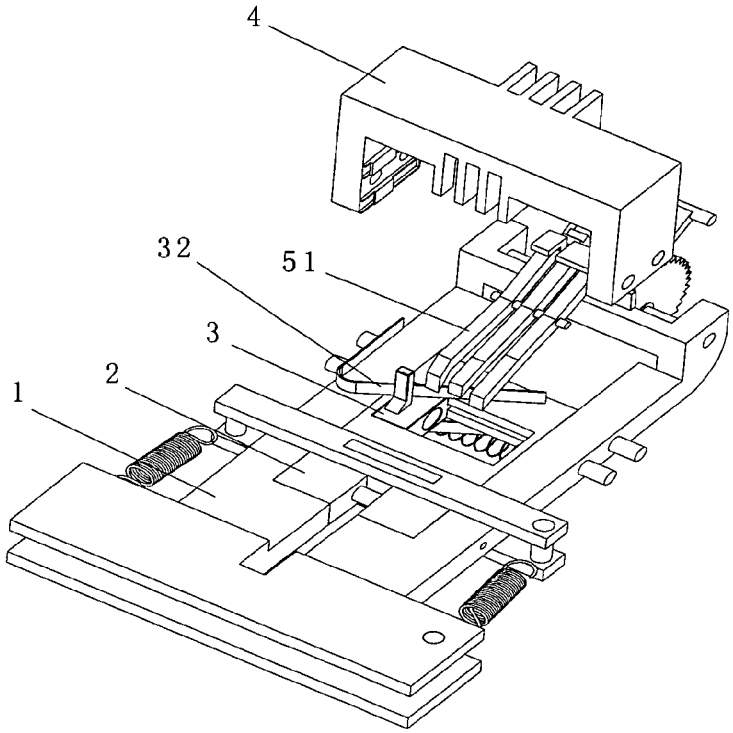
FIG. 7 is a separated schematic drawing of the sorting gate of the coin denomination identification mechanism of the first embodiment of the present invention.
Figure 8:
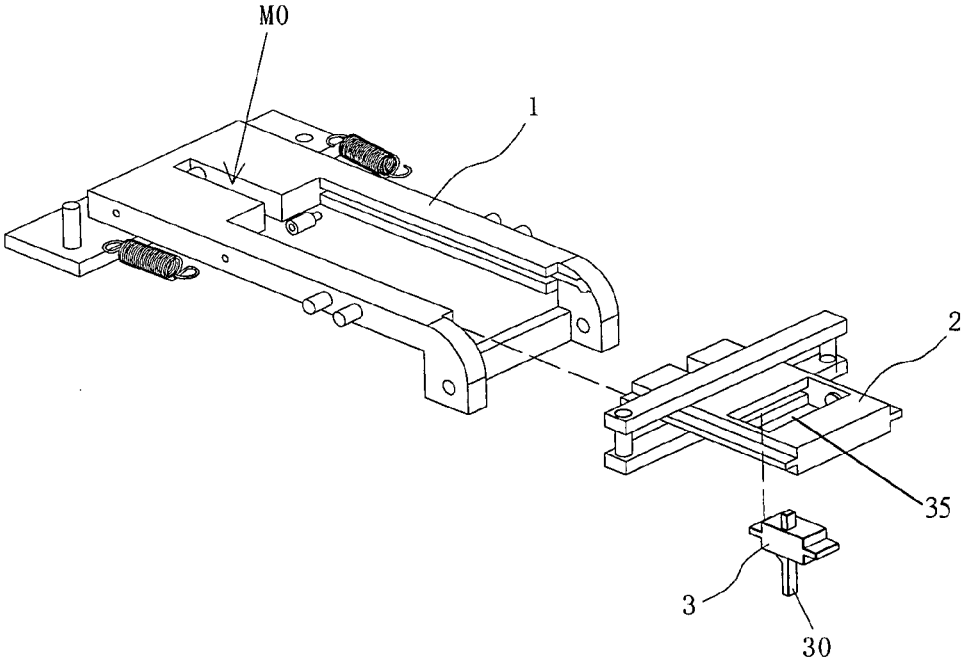
FIG. 8 is a schematic drawing of the frame, the fender and the mover of the coin denomination identification mechanism of the first embodiment of the present invention.
Figure 9:
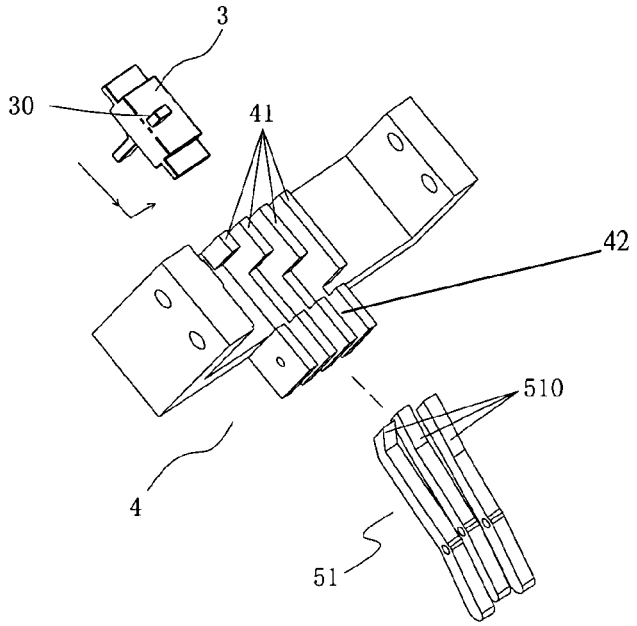
FIG. 9 is a structural drawing of the sorting gate of the coin denomination identification mechanism of the first embodiment of the present invention.
Figure 12:
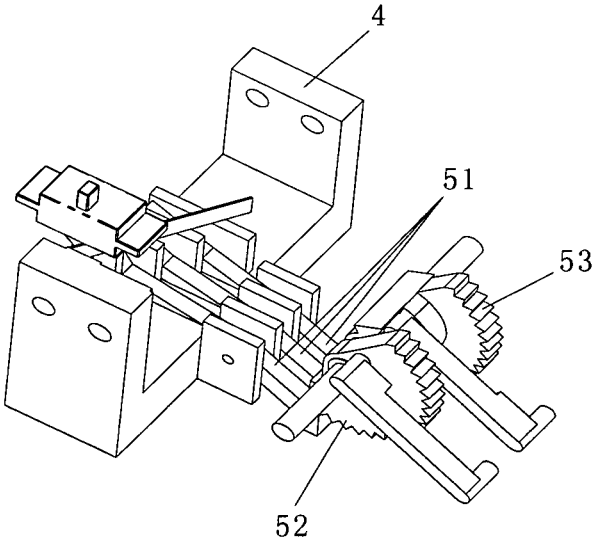
FIG. 12 is a schematic drawing of the drive rods in interaction with the sector gear set according to the first embodiment of the present invention.

As shown in FIGS. 1-3, the moveable end of the present invention is a moveable fender 2, which is capable of reciprocating along the direction of where the coin slot is oriented, and is provided with a vertical chute 35 for receiving the mover 3; the moveable end, while moving horizontally and linearly, drives the mover to move vertically along the vertical chute, the mover also having interaction with a slope spring leaf 32 and a compression spring 33 so that it can move along the composite slash track, the movement of the mover 3 being also restricted by the sorting gate 4. As shown in FIG. 9 or 12, each of the channels of the sorting gate 4 has a blocking gate 41, with a blocking length of each blocking gate 41 along a linear moving direction of the moveable fender corresponding to a specific diameter of a coin of a specific denomination; coins of different diameters cause the moveable fender to move linearly by different distances, making the mover 3 jump in translation so that the drive needle is capable of entering different channels to achieve the coin denomination identification. As shown in FIG. 9, the blocking gates 41 in the sorting gate are arranged based on the blocking length of each blocking gate from small to large; the drive needle 30 is capable of passing the blocking lengths from small to large during translation with the mover from small to large based on the different distances moved by the moveable fender. As shown in FIG. 1 or 3, both ends of the moveable fender 2 are connected with the frame 1 through tension springs 10 to reset the moveable fender after the coin is deposited, with the moveable end making a maximum translation corresponding to a diameter of the coin deposited through the coin slot; the drive needle 30 of the mover 3 is capable of entering different channels after the maximum translation of the moveable end, and when the drive needle 30 returns from a corresponding channel that has been entered after the maximum translation of the moveable fender, the drive needle 30 acts on a drive rod slope 510; the drive needle 30 is separated from the corresponding channel when reaching the end of the drive rod slope, and then moves back to the initial position under resetting force of the compression spring 33.

Figure 10:
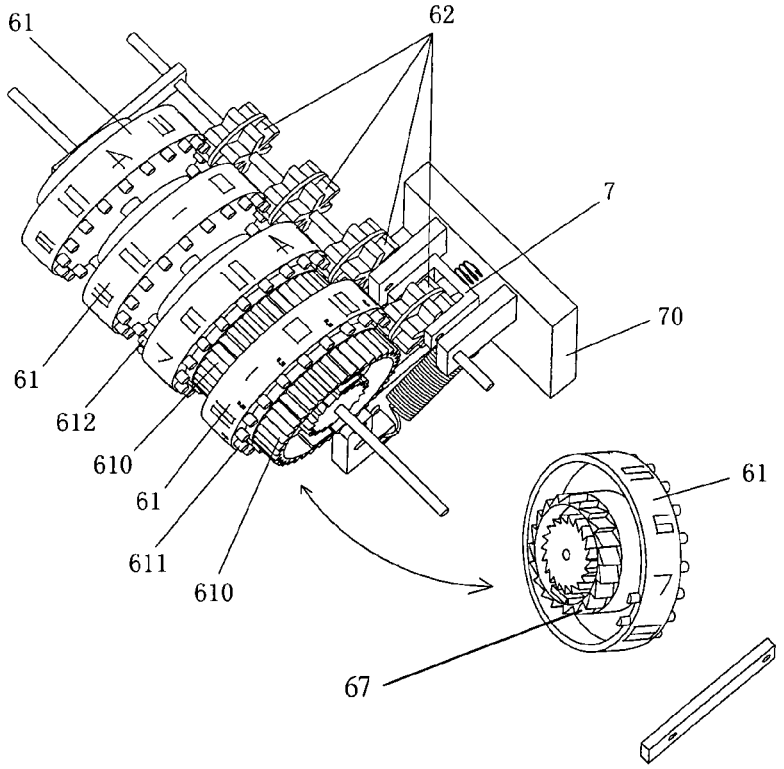
FIG. 10 is a schematic drawing of the coin denomination summation mechanism of the first embodiment of the present invention.
Figure 13:
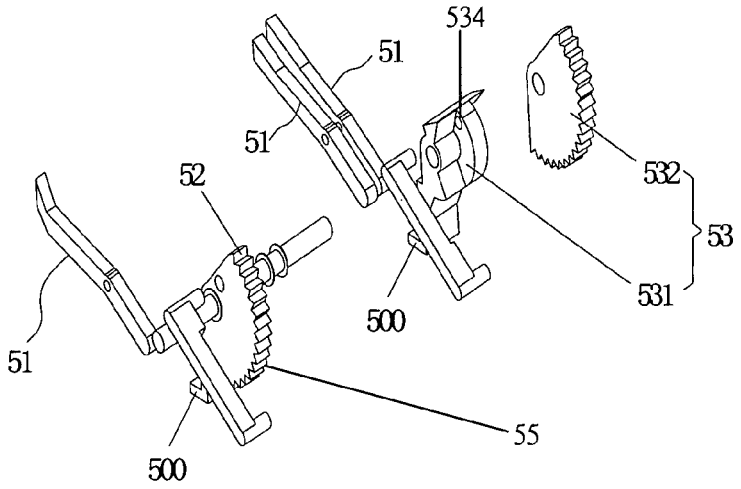
FIG. 13 is a schematic drawing of the sector gear set of the first embodiment of the present invention.

As shown in FIGS. 9, 12 and 13, the drive mechanism 5 of the present invention, as a gear engaging mechanism, comprises a sector gear set 50, wherein the sector gear set has trigger ends 500 interacting with the drive rods 51 to receive mechanical trigger from the drive rods, and tooth portions 55 of the sector gears are each engaged with an outer gear 610 on the side of a corresponding counter wheel and for driving the counter wheel to achieve the coin denomination summation. The coin denomination summation mechanism includes a set of one-way rotary counter wheels 61, with each of the counter wheels being marked on its annular ring with a scale 63. As shown in FIG. 3 or 10, each of the counter wheels has a group of digits 64 indicating denomination of the deposited coin; the counter wheels for ones position and tens position are provided with a one-way drive ratchet respectively, while other counter wheels are provided inside with a one-way positioning ratchet; the mechanical trigger sent from the coin denomination identification mechanism acts on an outer gear of the drive ratchets of the ones and tens positions through the drive mechanism and drives the corresponding counter wheel to rotate; each of the counter wheels is provided on the right periphery with several count linkage teeth 611 and on the left periphery with a linkage tooth 612 for digit carrying; a linkage wheel 62 is provided between adjacent counter wheels to move the adjacent counter wheels simultaneously for the purpose of carrying digit: wherein a wheel for ones position is used for denomination summation of 1-dime coins, driven by one drive rod, and used for summation of a whole unit, and a digit is carried forwarded from the counter wheel for ones position to the counter wheel for tens position in every counts of 10 units at the counter wheel for ones position; the counter wheel for tens position is used for denomination summation of 5-dime and 10-dime (1-dollar) coins, and driven by two drive rods, the counter wheel for tens position counts a whole digit or half a digit in the tens position; a digit is carried forward to the counter wheel for hundreds position for every ten digits counted in the tens position, or half a digit is carried forward to the counter wheel for hundreds position each time so that a whole digit is carried forward to the counter wheel for hundreds position in two times.

Figure 11:
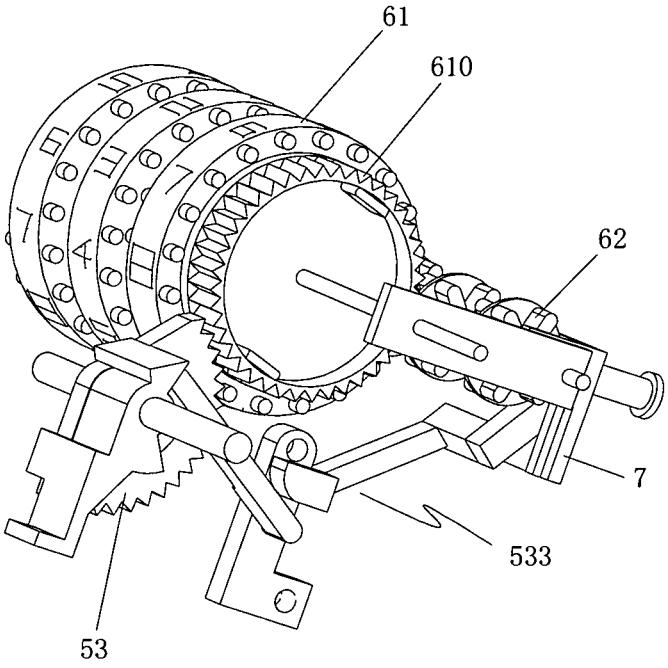
FIG. 11 is a structural drawing of a digit carrying linkage mechanism of the coin denomination summation mechanism of the first embodiment of the present invention.

As shown in FIGS. 12 and 13, the sector gear set of the drive mechanism of the present invention comprises a first drive wheel 52 and a second compound wheel 53, both of which are biased on one side to an initial position where they contact the drive rods but do not receive any mechanical trigger from the drive rods; the first drive wheel 52, capable of interacting with one drive rod and being in linkage with the counter wheel for ones position, is provided with a reset connection hole 534 for connecting a connecting rod 521 and an elastic member being a spring 520 that is elastically fixed at the base 70; the second compound wheel 53 is capable of interacting with two drive rods and it is in linkage with the counter wheel for tens position; the second compound wheel 53 comprises an active wheel 531 and a passive sector wheel 532, the active wheel being provided with a reset connection hole 534 for connecting the connecting rod 521 and the spring 520 and being elastically fixed in the initial position, the passive sector wheel 532 being in differential drive with the active wheel 531; the drive rods corresponding to the active wheel is capable of producing a mechanical trigger on the active wheel 531; the active wheel, when rotating differently compared with the passive sector wheel, sends a mechanical trigger through a clutch connecting rod mechanism 533, which acts on a clutch frame 7 of a corresponding linkage wheel to separate the corresponding linkage wheel from the corresponding adjacent counter wheels. As shown in FIG. 11, the active wheel, after differential rotation relative to the passive wheel, is in linkage with the passive sector wheel which then engages and is in linkage with a corresponding drive ratchet on a corresponding counter wheel; the linkage wheel 62 between the counter wheels for ones and tens positions is mounted on the clutch frame 7, which is positioned on the base 70 by the elastic member and is controlled by the active wheel 531 of the second compound wheel 53, with the linkage wheel between the counter wheel for ones position and the counter wheel for tens position capable of being separated from the counter wheel for ones position and the counter wheel for tens position to avoid interference with the counter wheel for ones position.

The coin denomination identification mechanism of the present invention comprises a frame; an end of the frame 1 is provided with a coin slot MO which has a moveable fender at the other end; the moveable fender slides back and forth along chutes of two beams disposed respectively on both sides of the frame, with the sorting gate fixed on a crossbeam of the frame; the movable fender is provided at its center with an indentation, which is provided with a chute opened from its front side to its rear side, with the mover disposed in the indentation and being capable of translating laterally along the chute; the mover has a shaft extending out from the upper and bottom sides of the mover, and the mover's translation is limited by the slope spring leaf, with the fixed side of the slope spring leaf disposed on the side wall of the protrusion of the sorting gate.

The coin denomination summation mechanism B of the present invention includes a set of one-way rotary counter wheels 61, each of the counter wheels being marked on its annular ring with a scale comprising a group of digits 0, 1, 2, 3, 4, 5, 6, 7, 8 and 9 for indicating denomination of the deposited coin.

The coin deposit and summation device of the present invention can achieve identification and denomination summation of 0.5, 0.25 and 0.2 dollar coins. The present invention determines different mechanical movement paths according to different diameters of different coin denominations, with each mechanical movement path resulting in a mechanical trigger corresponding to the identified coin denomination; each resulting mechanical trigger drives a mechanical counter wheel to perform denomination summation once according to the identified coin denomination.

The present invention mainly comprises a mechanical structure for identifying coin denomination (a coin denomination identification mechanism) and a coin denomination summation mechanism:

I. The Mechanical Structure for Identifying Coin Denomination:

The mechanical structure for identifying coin denomination is provided with a coin slot, which is immovable on one end and moveable on the other end to adapt to different diameters of deposited coins; the moveable end is provided with a mover that can move vertically, with the mover provided with a drive needle; a sorting gate is provided in front of the drive needle, the sorting gate has more than one channel respectively corresponding to different denominations of coins; the moveable end, while moving linearly, drives the mover to move vertically, with the mover provided with the slope spring leaf on one side and the compression spring on the other side; the mover, while moving vertically, is subjected more to a lateral pushing force of the slope spring leaf than the force of the compression spring, thereby translating in a manner restricted by the sorting gate; each of the channels of the sorting gate has a blocking gate, with a blocking length of each of the blocking gate along a linear moving direction of the moveable fender corresponding to a specific diameter of a coin of a specific denomination; coins of different diameters cause the moveable fender to move linearly by different distances, thereby causing the mover to jump in translation so that the drive needle is able to enter different channels to achieve the coin denomination identification.

The moveable end is provided with a mover, which can have vertical translation; the mover, when entering the sorting gate, is subjected to an oblique force imposed by the slope spring leaf as well as the force of the compression spring, with the oblique force of the slope spring leaf being greater than the force of the compression spring; before the mover enters the sorting gate, the slope spring leaf is not in contact with the mover and so the mover is free from the force imposed by the slope spring leaf.

The coin denomination identification mechanism comprises a frame provided at an end with a coin slot, which has a moveable end at the other end, with the moveable fender fixed to the moveable end; while a coin passes the coin slot, the moveable end makes the maximum translation corresponding to diameter of the coin, and the mover in the moveable end enters a corresponding channel according to the maximum translation; the blocking gates in the sorting gate are arranged based on blocking lengths from small to large; the drive needle is capable of passing the blocking lengths from small to large during translation from small to large.

II. The Coin Denomination Summation Mechanism:

The coin denomination summation portion of the present invention is a set of counter wheels that will carry a digit forward in every counts of 20; the counter wheels rotate only in one direction, and each counter wheel has a minimum scale of 0.5 increment; in the present embodiment, "0.5" is marked between every adjacent digits on the counter wheel for tens position for summation of 5-dime (0.5 dollar) coins; the counter wheels for ones and tens positions are each provided with a 20-tooth one-way drive ratchet, while the other counter wheels are each provided with a one-way 20-tooth positioning ratchet; the mechanical trigger sent from the corresponding drive rods of the coin denomination identification mechanism is in linkage with the corresponding counter wheel by gear engagement; in the present embodiment, the counter wheel for ones position is used for summation of a whole digit and carries a digit forward to the counter wheel for tens position in every counts of 10 digits (ten 1-dime coins); the counter wheel for tens position counts a whole digit (1 dollar) or half a digit (5-dime) in each count; a digit is carried forward to the counter wheel for hundreds position for every ten digits counted in the tens position, or a digit is carried forward to the counter wheel for hundreds position in two times in which half a digit is first carried forward to the counter wheel for hundreds position when reaching a count of nine and a half digits (9.5) in the tens position, and another half a digit is then carried forward to the counter wheel for hundreds position when there is a subsequent count of half a digit in the tens position.

The present invention will encounter a problem of interference; specifically, when half a digit is first carried from a first counter wheel to a second counter wheel while the remaining half of the digit is not carried yet, rotation of the second counter wheel will cause the count linkage teeth of the second counter wheel to rotate the linkage wheel between the first and the second counter wheels and thus rotate the first counter wheel as well, thereby interfering the first counter wheel; in order to eliminate the interference, the linkage wheel between the first counter wheel and the second counter wheel is designed to be as follows: the linkage wheel is mounted on a clutch frame, and the clutch frame is positioned on the base to separate the linkage wheel from the first counter wheel and the second counter wheel elastically by the spring.

The solution concerning the clutch frame is specifically as follows:

The second compound wheel comprises an active wheel and a passive sector wheel, the active wheel being provided with a reset connection hole for connecting a connecting rod and a spring and being elastically fixed in the initial position, the passive sector wheel being in differential drive with the active wheel, the drive rod producing a mechanical trigger on the active wheel; the active wheel, when rotating differently compared with the passive sector wheel, delivers a mechanical trigger acting on the clutch frame to separate the linkage wheel from the first counter wheel and the second counter wheel; the active wheel, after differential rotation relative to the passive wheel, is in linkage with the passive sector wheel, which then engages and is in linkage with the drive ratchet on the second counter wheel; therefore, the second counter wheel, while rotating to perform denomination summation, does not interfere with the first counter wheel causing the first counter wheel to rotate through the linkage wheel between the first counter wheel and the second counter wheel.

The present invention can be designed to perform denomination summation of 0.5 dollar coins, 0.25 dollar coins and 0.2 dollar coins:

| | denomination summation of 0.5 dollar coins | denomination summation of 0.25 dollar coins | denomination summation of 0.2 dollar coins |
|---|---|---|---|
| Minimum increment on the counter wheel | 0.5 | 0.25 | 0.2 |
| Number of teeth of the positioning ratchet | 20 | 40 | 50 |
| Number of times to compete carrying a whole digit to the next counter wheel | 2 | 4 | 5 |
| Rotation angle of the counter wheel per minimum increment | 18 degrees | 9 degrees | 7.2degrees |

Example 2

As shown in FIGS. 14 to 19, a coin deposit and summation device is provided, comprising a coin denomination identification mechanism A and a coin denomination summation mechanism B, with the coin denomination identification mechanism and the coin denomination summation mechanism disposed on a chassis 29, wherein:

the coin denomination identification mechanism A includes a frame 21 provided at an end with a coin slot MO, which has a moveable end (a moveable frame 22) to adapt to different diameters of deposited coins; the moveable end is provided with a mover 23 having a drive needle 230, with the mover 23 moving along a composite slash track and cooperating with a sorting gate 24 to perform sorting operation on different denominations of coins; the sorting gate 24 has more than one channel respectively corresponding to different denominations of coins, with each channel being provided with a drive rod 251 that is capable of interacting with the drive needle 230 entering the channel to thereby generate a mechanical trigger corresponding to the coin denomination being identified; and the coin denomination summation mechanism B includes a set of one-way rotary counter wheels 261, with the counter wheels for ones, tens and hundred positions provided with a one-way drive ratchet respectively; the drive ratchets are connected with a drive mechanism 25 to receive the mechanical trigger sent from the coin denomination identification mechanism and correspondingly drives their corresponding counter wheels to achieve coin denomination summation.

Figure 15:
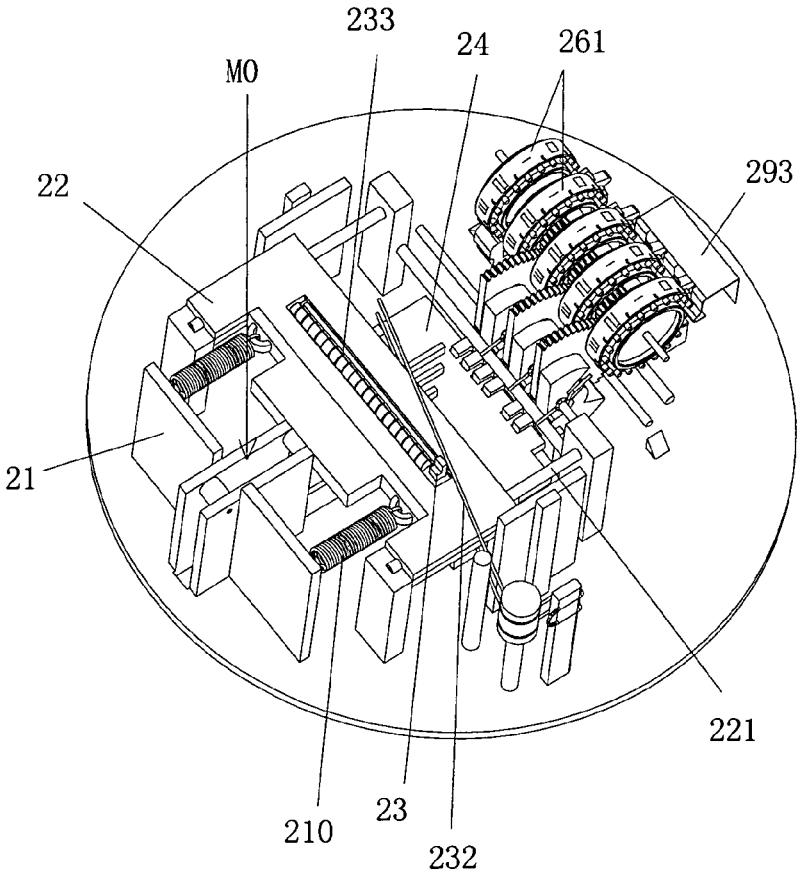
FIG. 15 is a schematic drawing of the coin deposit and summation device according to the second embodiment of the present invention, wherein the upper cover is not shown.
Figure 16:
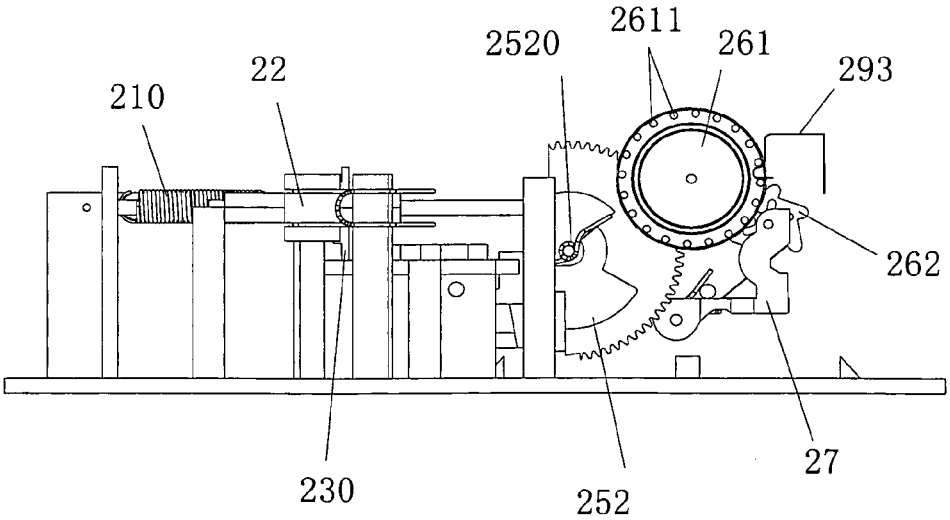
FIG. 16 is a side view of FIG. 15.
Figure 17:
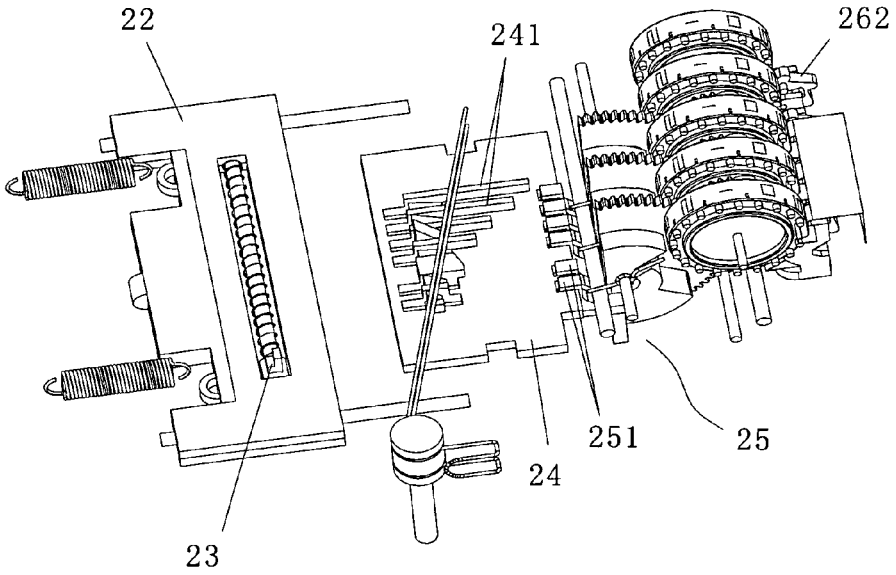
FIG. 17 is a schematic drawing showing partially the structure of the coin deposit and summation device of the second embodiment of the present invention.
Figure 18:
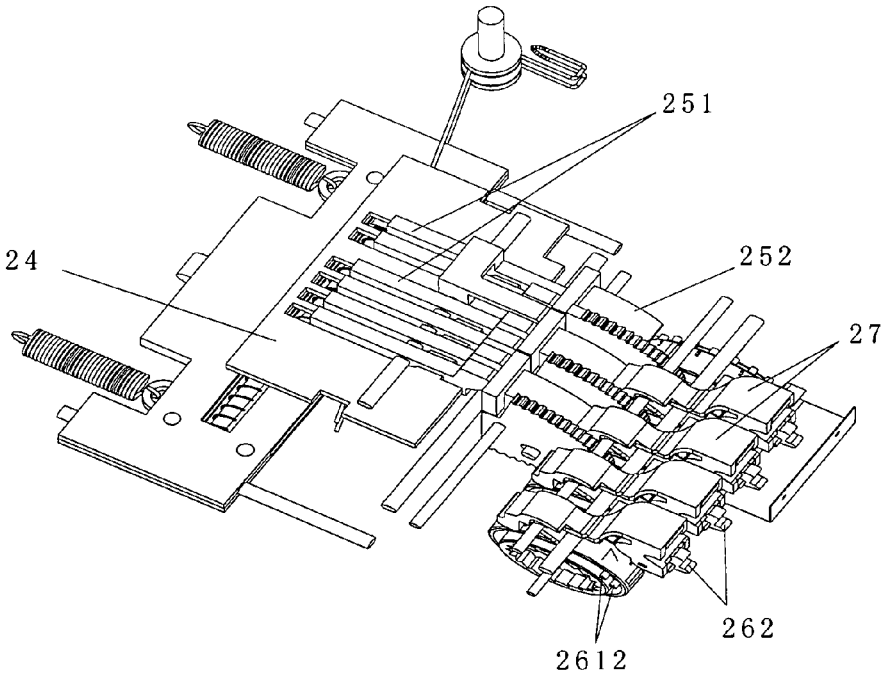
FIG. 18 is another schematic drawing showing partially the structure of the coin deposit and summation device of the second embodiment of the present invention.
Figure 19:
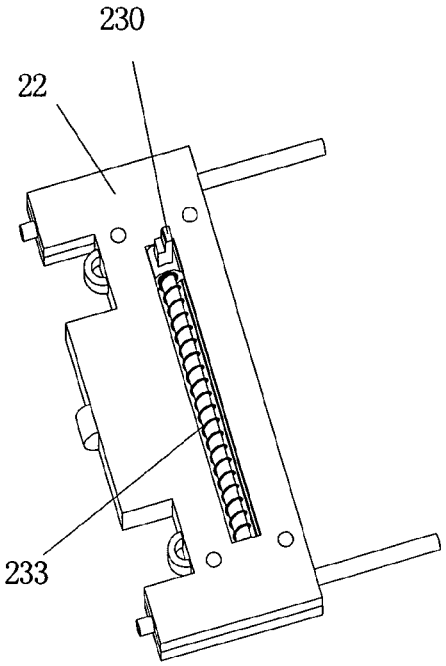
FIG. 19 is a schematic drawing of the moveable frame of the second embodiment of the present invention.

As shown in FIGS. 15-17, the moveable end of the present invention is a moveable fender 22, which is capable of reciprocating along the direction which the coin slot is oriented and is provided with a vertical chute for receiving the mover 23; the moveable end, while moving horizontally and linearly, drives the mover to move vertically, the mover also having interaction with a slope spring 232 and a compression spring 233 so that it can move along the composite slash track, the movement of the mover 23 being also restricted by the sorting gate 24. As shown in FIG. 17, each of the channels of the sorting gate 24 has a blocking gate 241, with a blocking length of each blocking gate 241 along a linear moving direction of the moveable fender corresponding to specific diameter of a coin of a specific denomination; coins of different diameters cause the moveable end to move by different distances, making the mover 23 jump in translation so that the drive needle is capable of entering different channels; the blocking gates 241 in the sorting gate are arranged based on the blocking length from small to large, which causes the drive needle 230 to pass the blocking lengths from small to large during translation from small to large. As shown in FIG. 15 or 16, the moveable fender 22 is connected on both ends with the frame 21 through tension springs 210 to reset after a coin is deposited; while a coin passes the coin slot, the moveable end makes maximum translation corresponding to the diameter of the coin being deposited; the drive needle 230 of the mover 23 in the moveable fender is capable of entering different channels, and then acts on a drive rod slope 2510 of a corresponding channel it enters as it returns from the corresponding channel, thereby sending a mechanical trigger to the coin denomination summation mechanism to achieve coin denomination summation; the drive needle 230 is separated from the corresponding channel when reaching the end of the drive rod slope, and then moves back to the initial position under the action of the compression spring 233.

Figure 14:
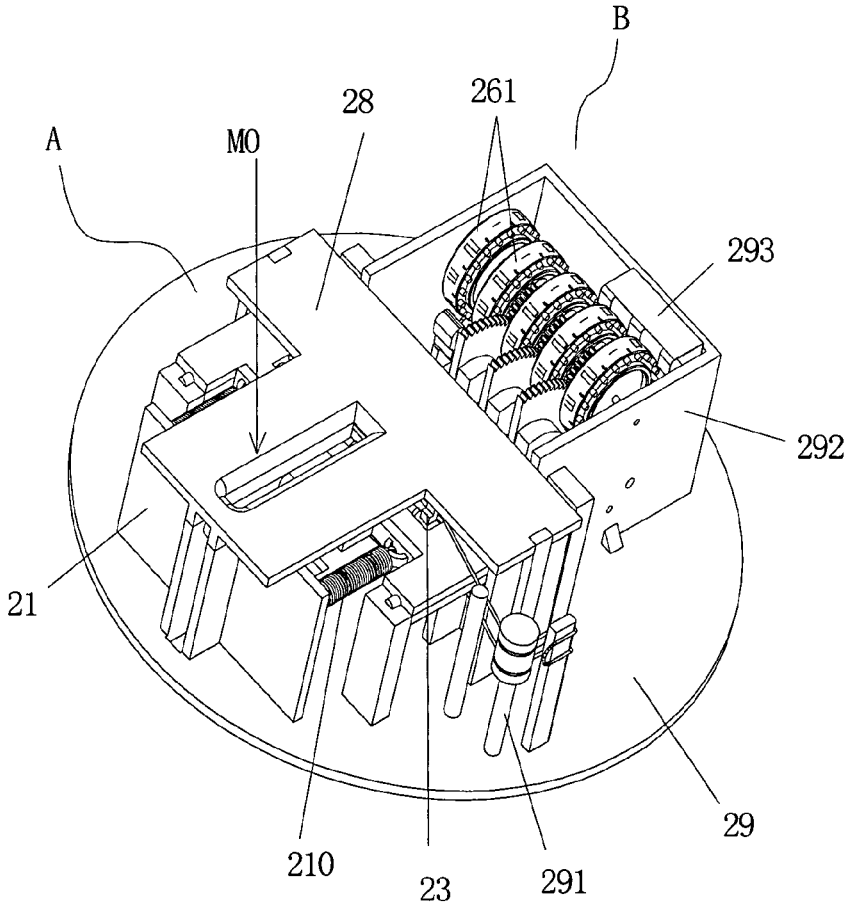
FIG. 14 is a schematic drawing of the coin deposit and summation device according to the second embodiment of the present invention.
Figure 26:
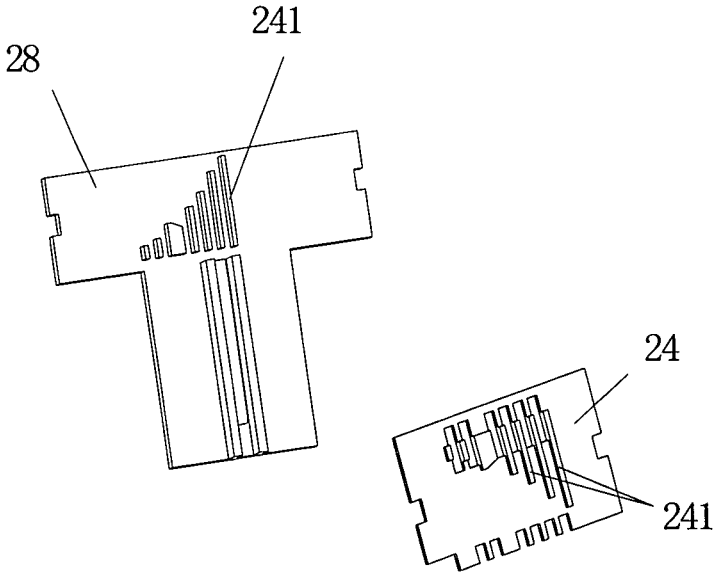
FIG. 26 is a schematic drawing of the upper cover plate and the sorting gate of the second embodiment of the present invention.

As shown in FIGS. 14 and 26, an upper cover plate 28 is provided on the sorting gate 24, the upper cover plate is also provided with blocking gates that correspond to the blocking gates of the sorting gate 24; cooperation of the sorting gate 24 with the upper cover plate 28 enables the mover 23 to be subjected to a force symmetrically, making the mechanism stable.

As shown in FIGS. 18, 20, 21 and 22, the drive mechanism 25 of the present invention, as a gear engaging mechanism, comprises a sector gear set, wherein each sector gear has a trigger end 2500 that is capable of interacting with a corresponding drive rod 251 to receive the mechanical trigger sent from the corresponding drive rod, and the tooth portion of each sector gear is engaged with an outer gear 2610 (i.e. a one-way drive ratchet) on one side of a corresponding counter wheel to drive the counter wheel to achieve coin denomination summation; each counter wheel has a scale comprising a group of digits indicating denomination summation of the deposited coins; the counter wheels for ones, tens and hundreds positions are provided with a one-way drive ratchet respectively; the mechanical trigger sent from the coin denomination identification mechanism acts on the corresponding outer gear (i.e. corresponding one-way drive ratchet) through the drive mechanism and drives the corresponding counter wheel to rotate; each of the counter wheels is provided on the right periphery with several count linkage teeth 2611 and on the left periphery with a linkage tooth 2612 for carrying digit, with a linkage wheel 262 provided between adjacent counter wheels for carrying digit. In the present embodiment, the counter wheel for ones position is used for denomination summation of 1-cent coins, driven by one drive rod, and used for summation of a whole digit, and carrying a digit forward to the counter wheel for tens position in every counts of ten digits; the counter wheel for tens position is used for summation of 5-cent, 1-dime and 25-cent coins and driven by three drive rods, a whole digit is carried forward to the counter wheel for hundreds position each time or just half a digit is carried forward to the counter wheel for hundreds position each time, in other words, a whole digit is carried forward to the counter wheel for hundreds position in every counts of ten digits in the tens position, or half a digit is first carried forward and then another half of the digit is carried forward later, thereby carrying a whole digit forward in two times; the counter wheel for hundreds position is used for summation of 5-dime and 1-dollar coins and driven by two drive rods, the manner of carrying a digit forward from the counter wheel for hundreds position to the counter wheel for thousands position is the same as how a digit is carried forward from the counter wheel for tens position to the counter wheel for hundreds position.

Figure 20:
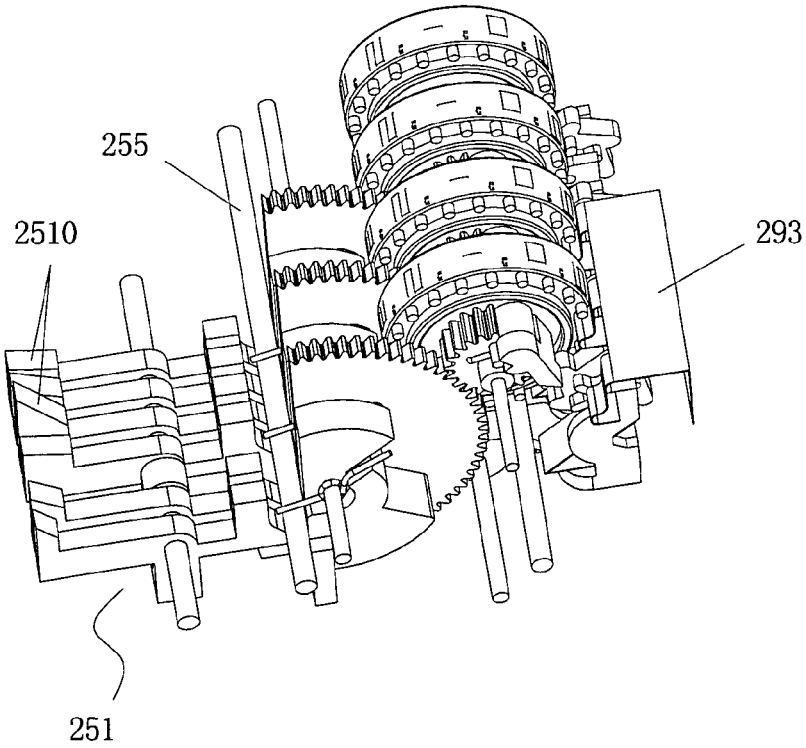
FIG. 20 is a schematic drawing of the drive rods in interaction with the sector gear set of the second embodiment of the present invention.
Figure 22:
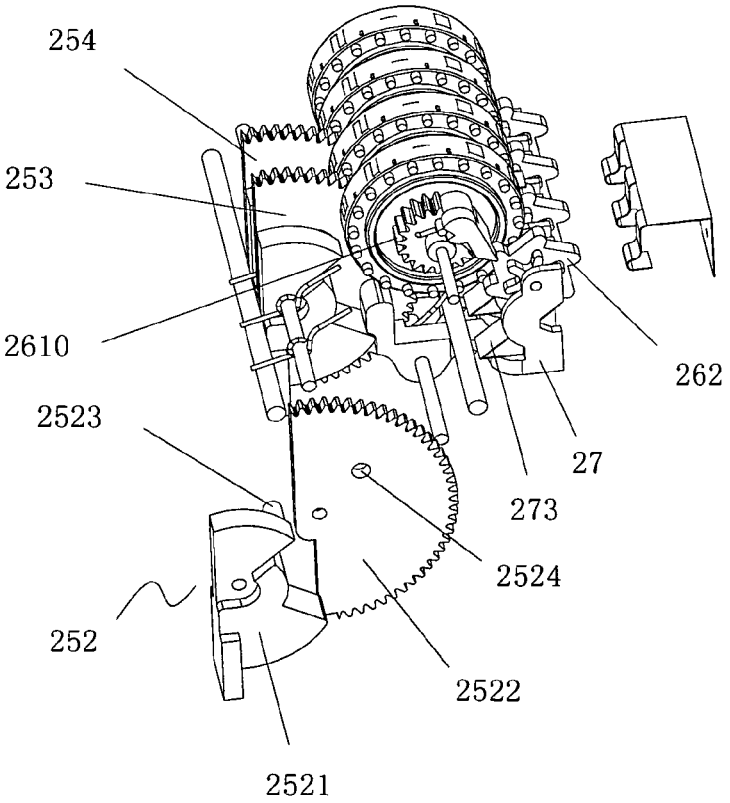
FIG. 22 is an exploded view showing partially the structure of the sector gear set of the second embodiment of the present invention.

As shown in FIGS. 20 and 22, the sector gear set of the drive mechanism of the present invention comprises a first drive wheel 252, a second compound wheel 253, and a third compound wheel 254, three of which are biased on one side to the initial position where mechanical triggers from the corresponding drive rods 251 are not received; the first drive wheel 252 is capable of interacting with a drive rod and is in linkage with the counter wheel for ones position, delivering one kind of mechanical trigger; the second compound wheel 253 is capable of interacting with three drive rods and is in linkage with the counter wheel for tens position, delivering three kinds of mechanical triggers; the third compound wheel 254 is capable of interacting with two drive rods and is in linkage with the counter wheel for hundreds position, delivering two kinds of mechanical triggers. The addition of a set of compound wheels to the drive mechanism of the present invention is for receiving triggers to perform denomination summation of 5-dime and 1-dollar coins.

The first drive wheel 252, the second compound wheel 253 and the third compound wheel 254 are all composed of an active wheel 2521 and a passive sector wheel 2522; the mechanical trigger of the corresponding drive rod 251 acts on the active wheel, which is provided with a torsion spring 2520 and therefore being elastically fixed in the initial position, with one end of the torsion spring 2520 abutting against a first column 255. The sector gear set uses the torsion spring 2520 to reset the active wheel, thus saving space and making the mechanism more compact.

Figure 23:
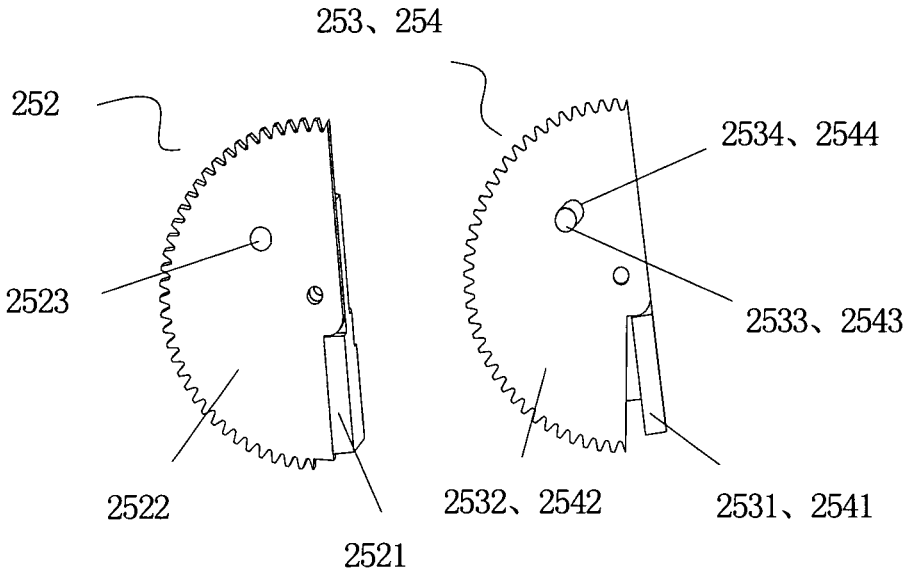
FIG. 23 contrasts the first drive wheel to the second compound wheel or the third compound wheel of the second embodiment of the present invention.

As shown in FIGS. 22 and 23, the active wheel 2521 of the first drive wheel 252 is provided with a lug 2523, which is inserted into the mounting hole 2524 of the passive sector wheel 2522 of the first drive wheel 252, with the lug 2523 on the active wheel 2521 of the first drive wheel 252 acting inside the mounting hole 2524 and driving the passive sector wheel 2522 to rotate.

Figure 21:
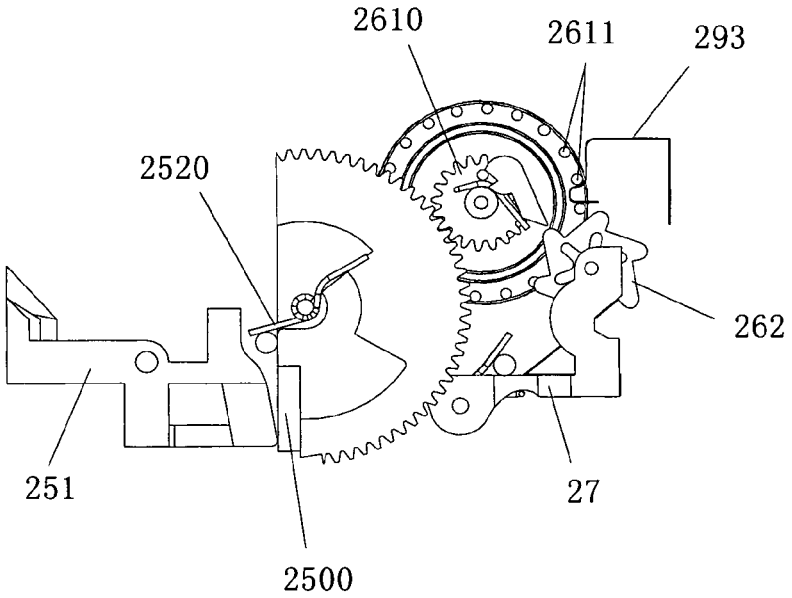
FIG. 21 is a side view of FIG. 20.

As shown in FIG. 23, the active wheels of the second compound wheel 253 and the third compound wheel 254 are also provided with a lug, respectively, the lug 2533 on the active wheel 2531 of the second compound wheel 253 being located in a differential hole 2534 of the passive sector wheel 2532 of the second compound wheel 253, the lug 2543 on the active wheel 2541 of the third compound wheel 254 being located in a differential hole 2544 of the passive sector wheel 2542 of the third compound wheel 254, with the lug on the active wheel of the second compound wheel 253 and the third compound wheel 254 able to be relatively displaced in the corresponding differential hole, thus achieving differential drive with the passive sector wheel; the active wheel of the second compound wheel 253 and the third compound wheel 254, while rotating differently compared with the passive sector wheel, delivers a mechanical trigger acting on a clutch frame 27 of the linkage wheel 262 between two corresponding counter wheels to separate the linkage wheel. As shown in FIG. 21, the active wheel, after differential rotation relative to the passive sector wheel, is in linkage with the passive sector wheel, which then engages and is in linkage with the one-way drive ratchet on the counter wheel through this passive sector wheel.

The linkage wheels between the counter wheels are mounted on the clutch frame 27 to which they respectively correspond, with the clutch frame 27 positioned by the elastic member; the elastic member is preferably a torsion spring 271, both ends of which abut against the clutch frame 27 and the second column 272, respectively, advantageous to saving space. The active wheel of the second compound wheel 253 controls the clutch frame corresponding to the linkage wheel between the counter wheels for ones and tens positions, and the active wheel of the third compound wheel 254 controls the clutch frame corresponding to the linkage wheel between the counter wheels for tens and hundreds positions, thereby separating the linkage wheels from their corresponding counter wheels to avoid interference.

Figure 24:
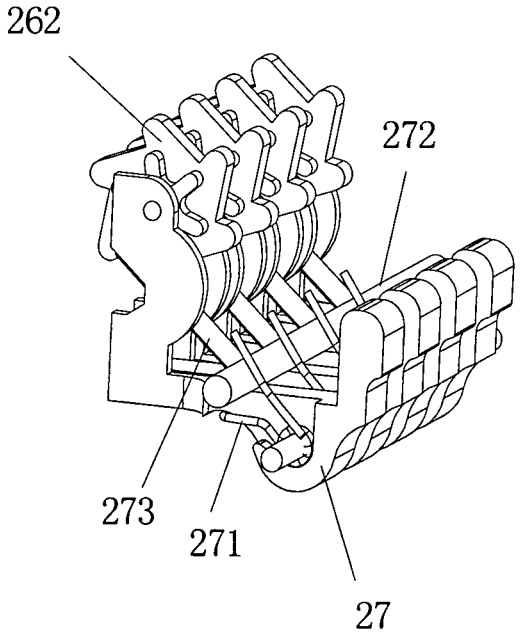
FIG. 24 is a schematic drawing of the clutch frame of the second embodiment of the present invention.
Figure 25:
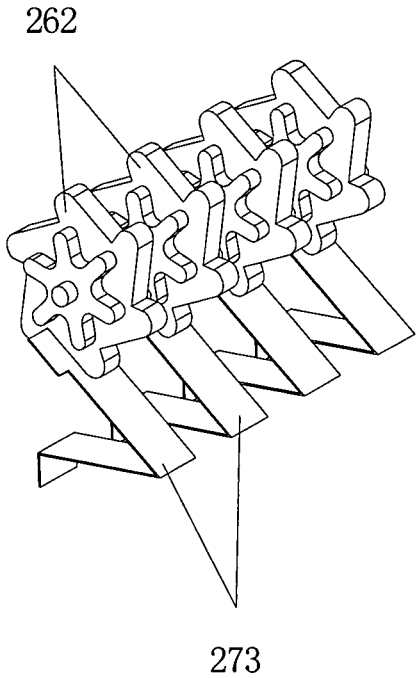
FIG. 25 is a schematic drawing of the linkage wheels and the positioning elastic sheet of the second embodiment of the present invention.

As shown in FIGS. 24 and 25, the clutch frame 27 is provided with a positioning elastic sheet 273, one end of which acts on the tooth position of the linkage wheel 262; the positioning elastic sheet 273 can improve the mechanical stability, and eliminate the drift that may occur after separation of the linkage wheel from the counter wheels.

Besides, as shown in FIGS. 15, 21 and 22, the coin denomination summation mechanism also comprises a one-way clipping spring leaf 293, which is mounted on a mounting seat 292 of the coin denomination summation mechanism; the spring leaf of the one-way clipping spring leaf 293 cooperates in positioning with the count linkage tooth 2611 on the right periphery of the counter wheel, which is equal to the outer ratchet positioning, but is more convenient to produce and saves space.

The coin denomination identification mechanism of the present invention comprises a frame provided at an end with a coin slot MO, which has a moveable fender at the other end; the movable fender slides back and forth along guide posts 221 on both sides of the frame, with the sorting gate fixed on the crossbeam of the frame; the fender is provided at its center with an indentation, which is provided with a chute opened from its front side to its rear side, with the mover disposed in the indentation and being in vertical translation along the chute; the mover has a shaft extending out from the upper and bottom sides and is limited by the slope spring 232 and the blocking gates 241 for jumping and translation, with the slope spring fixed at one end to a mounting post 291 of the chassis 29.

The coin deposit and summation device of the present invention can achieve denomination identification and summation of 0.5 dollar coins, 0.25 dollar coins and 0.2 dollar coins. The present invention determines different movement paths according to different diameters of different coin denominations, with each mechanical movement path resulting in a mechanical trigger corresponding to the identified coin denomination; each resulting mechanical trigger drives a mechanical counter wheel to perform denomination summation once according to the identified coin denomination.

The present invention is different from the prior arts in terms of function and structure, as explained as follows:

I. Differences in Function:

1. The present invention, recording the denomination summation mechanically, does not need electrical energy; the existing intelligent memory function needs power supply and consumes a battery, with the battery needing to be replaced when used up.

2. The present invention achieves the coin denomination summation with the summation displayed as **hundred*ten dollars*dollar*dime*cent orthousandhundred*ten dollars*dollar*dime*cent; the existing intelligent memory function can only achieve summation of units of coins, with the summation displayed as *units of coins;

II. Differences in Structure:

1. The present invention has a purely mechanical structure, while the existing intelligent memory moneybox is composed of an electronic circuit board and an LCD screen.

2. The present invention achieves the mechanical coin denomination identification, with the same coin slot receiving coins and outputting a mechanical trigger to the coin denomination summation mechanism according to the coin denomination being identified.

3. The mechanical counter wheels of the present invention are relatively independent in the working state at tens and ones positions, or hundreds, tens and ones positions, achieving summation of coins of different denominations, e.g. a 1 dime coin can be counted in the ones position, and a one dollar coin can be counted in the tens position etc; the existing counter for the number of coins has a traditional counter structure that counts only the number of coins being deposited, not allowing summation of coins of different denominations.

4. While a second wheel rotates and performs denomination summation, it will not interfere with the first wheel.

5. The present invention allows summation of decimals such as summation of 0.5 dollar coins; by changing the number of teeth of the corresponding gears, the same thought and structure can be applied to summation of the coins similar to 25 cents (US$0.25); the same thought and structure can also be applied to summation of the coins similar to 20 euro cents (0.2 euro); the existing counter wheel can only perform summation of a whole unit and cannot perform summation of decimals.

The present invention has the following main features:

1. The present invention has the mechanical coin denomination summation function, with a coin slot for receiving coins and a counter device for displaying the summation result of the deposited coins.

2. The device of the present invention has the non-integral fraction summation function, solving the problem of 0.5-unit, 0.25-unit and 0.2-unit coin summation.

3. The present invention is a universal device having a whole-mechanical structure, which distinguishes different coin denominations according to the coin diameters, and thus performs the summation.

4. The present invention achieves summation that involves digit carrying.

What is claimed is:

1. A coin deposit and summation device comprising a coin denomination identification mechanism and a coin denomination summation mechanism, wherein the coin denomination identification mechanism comprises a frame; an end of the frame is provided with a coin slot; the coin slot has a moveable end; the moveable end is provided with a mover having a drive needle; the mover is movable along a composite slash track and cooperating with a sorting gate to perform sorting of coins of different denominations; the sorting gate has more than one channel; each channel is capable of receiving the drive needle; each channel corresponds to a respective coin denomination and each channel is provided with a drive rod capable of interacting with the drive needle;

the coin denomination summation mechanism comprises a set of one-way rotary counter wheels; a one-way drive ratchet is provided on each of a counter wheel for ones position and a counter wheel for tens position or provided on each of the counter wheel for ones position, the counter wheel for tens position and a counter wheel for hundreds position; the drive ratchets are connected with a drive mechanism which is capable of receiving mechanical triggers from the drive rods and then correspondingly drives the drive ratchets and thus the counter wheels to achieve coin denomination summation;

the drive mechanism comprises a sector gear set, wherein each sector gear of the sector gear set has a trigger end capable of interacting with one or more than one corresponding drive rods, and has a tooth portion engaging with an outer gear of a corresponding drive ratchet on a side of a corresponding counter wheel for driving the corresponding counter wheel;

a scale comprising a group of digits for indicating denomination summation is provided on each of the counter wheels; each of the counter wheels is provided on a right periphery with several count-linkage teeth and on a left side with a linkage tooth for carrying a digit; a linkage wheel is provided between adjacent counter wheels to move the adjacent counter wheels simultaneously for the purpose of carrying a digit;

the counter wheel for ones position is driven by one corresponding drive rod;

the counter wheel for tens position is driven by two corresponding drive rods; the counter wheel for tens position counts a whole digit or half a digit in each count; a digit is carried forward to the counter wheel for hundreds position for every ten digits counted in the tens position, or a digit is carried forward to the counter wheel for hundreds position in two times in which half a digit is first carried forward to the counter wheel for hundreds position when reaching a count of nine and a half digits in the tens position, and another half a digit is then carried forward to the counter wheel for hundreds position when there is a subsequent count of half a digit in the tens position;

the sector gear set comprises a first drive wheel and a second compound wheel, both of which are biased on one side to an initial position of being capable of receiving mechanical triggers from corresponding drive rods; the first drive wheel is capable of interacting with a corresponding drive rod and is in linkage with the counter wheel for ones position; the second compound wheel is capable of Interacting with two corresponding drive rods and is in linkage with the counter wheel for tens position;

the second compound wheel comprises an active wheel and a passive sector wheel, the active wheel is provided with a reset connection hole for connecting a connecting rod and an elastic member being a spring and is elastically fixed in the initial position, the passive sector wheel being in differential drive with the active wheel, a corresponding drive rod corresponding to the active wheel is capable of sending a mechanical trigger to the active wheel; the active wheel, when rotating differently compared with the passive sector wheel, delivers a mechanical trigger acting on a clutch frame of a linkage wheel between the counter wheel for ones position and the counter wheel for tens position to separate the linkage wheel; the active wheel, after differential rotation relative to the passive wheel, is in linkage with the passive sector wheel which then engages and Is in linkage with a corresponding drive ratchet on the counter wheel for tens position.

2. The coin deposit and summation device according to claim 1, wherein the moveable end is a moveable fender, which is capable of reciprocating along a direction which the coin slot is oriented; the moveable fender is provided with a vertical chute for receiving the mover; the moveable fender, while moving horizontally and linearly along the direction which the coin slot is oriented, drives the mover to move vertically along the vertical chute; the mover also interacts with a slope elastic member and a compression spring so that the mover is movable along the composite slash track; movement of the mover is also restricted by the sorting gate, with each channel of the sorting gate having a blocking gate; a blocking length of each blocking gate along a linear moving direction of the moveable fender corresponds to a specific diameter of a coin of a specific denomination; coins of different diameters cause the moveable fender to move linearly by different distances, thereby causing the mover to jump in translation so that the drive needle is able to enter different channels.

3. The coin deposit and summation device according to claim 2, wherein the slope elastic member comprises a slope spring leaf.

4. The coin deposit and summation device according to claim 2, wherein the blocking gates in the sorting gate are arranged based on the blocking length of each blocking gate from small to large; the drive needle is capable of passing the blocking lengths from small to large during translation with the mover based on the different distances moved by the moveable fender.

5. The coin deposit and summation device according to claim 2, wherein both ends of the moveable fender are connected with the frame through tension springs to reset the moveable fender after a coin is deposited; the moveable fender makes a maximum translation corresponding to a diameter of the coin deposited through the coin slot; the drive needle of the mover is capable of entering different channels after the maximum translation of the moveable fender; when the drive needle returns from a corresponding channel that has been entered after the maximum translation of the moveable fender, the drive needle acts on a drive rod slope of the drive rod in the corresponding channel; as the drive needle returns from the corresponding channel, the drive needle is separated from the corresponding channel when reaching an end of the drive rod slope, and then the drive needle moves back to an initial position under resetting force of the compression spring.

6. The coin deposit and summation device according to claim 1, wherein the linkage wheel between the counter wheel for ones position and the counter wheel for tens position is mounted on the clutch frame, the clutch frame is positioned on a base by the elastic member and is controlled by the active wheel of the second compound wheel, with the linkage wheel between the counter wheel for ones position and the counter wheel for tens position capable of being separated from the counter wheel for ones position and the counter wheel for tens position to avoid interference with the counter wheel for ones position.

7. A coin deposit and summation device comprising a coin denomination identification mechanism and a coin denomination summation mechanism, wherein the coin denomination identification mechanism comprises a frame; an end of the frame is provided with a coin slot; the coin slot has a moveable end; the moveable end is provided with a mover having a drive needle; the mover is movable along a composite slash track and cooperating with a sorting gate to perform sorting of coins of different denominations; the sorting gate has more than one channel; each channel is capable of receiving the drive needle; each channel corresponds to a respective coin denomination and each channel is provided with a drive rod capable of interacting with the drive needle; the coin denomination summation mechanism comprises a set of one-way rotary counter wheels; a one-way drive ratchet is provided on each of a counter wheel for ones position and a counter wheel for tens position or provided on each of the counter wheel for ones position, the counter wheel for tens position and a counter wheel for hundreds position; the drive ratchets are connected with a drive mechanism which is capable of receiving mechanical triggers from the drive rods and then correspondingly drives the drive ratchets and thus the counter wheels to achieve coin denomination summation;

a scale comprising a group of digits for indicating denomination summation is provided on each of the counter wheels; each of the counter wheels is provided on a right periphery with several count linkage teeth and on a left side with a linkage tooth for carrying a digit, a linkage wheel is provided between adjacent counter wheels to move the adjacent counter wheels simultaneously for the purpose of carrying a digit:

the counter wheel for ones position is driven by one corresponding drive rod;

the counter wheel for tens position is driven by three corresponding drive rods; the counter wheel for tens position counts a whole digit or half a digit in each count; a digit is carried forward to the counter wheel for hundreds position for every ten digits counted in the tens position, or a digit is carried forward to the counter wheel for hundreds position in two times in which half a digit is first carried forward to the counter wheel for hundreds position when reaching a count of nine and a half digits in the tens position, and another half a digit is then carried forward to the counter wheel for hundreds position when there is a subsequent count of half a digit in the tens position;

the counter wheel for hundreds position is driven by two corresponding drive rods;

the counter wheel for hundreds position counts a whole digit or half a digit in each count, and carries a digit forward to a counter wheel for thousands position in a manner which is the same as how a digit is carried forward from the counter wheel for tens position to the counter wheel for hundreds position;

the drive mechanism comprises a sector gear set, wherein each sector gear of the sector gear set has a trigger end capable of interacting with one or more than one corresponding drive rods, and has a tooth portion engaging with an outer gear of a corresponding drive ratchet on a side of a corresponding counter wheel for driving the corresponding counter wheel;

the sector gear set comprises a first drive wheel, a second compound wheel, and a third compound wheel, all of which being biased on one side to an initial position of being capable of receiving mechanical triggers from corresponding drive rods; the first drive wheel is capable of interacting with a corresponding drive rod and is in linkage with the counter wheel for ones position; the second compound wheel is capable of interacting with three corresponding drive rods and is in linkage with the counter wheel for tens position; the third compound wheel is capable of Interacting with the two corresponding drive rods and is in linkage with the counter wheel for hundreds position;

the first drive wheel, the second compound wheel and the third compound wheel each comprises an active wheel and a passive sector wheel; each active wheel is provided with a torsion spring and is elastically fixed in the initial position, with one end of the torsion spring abutting against a first column; a corresponding drive rod corresponding to a corresponding active wheel is capable of sending a mechanical trigger to that active wheel; each active wheel is provided with a lug, wherein the lug on the active wheel of the first drive wheel is inserted into a mounting hole of the passive sector wheel of the first drive wheel, the lug on the active wheel of the second compound wheel is located in a differential hole of the passive sector wheel of the second compound wheel, and the lug on the active wheel of the third compound wheel is located in a differential hole of the passive sector wheel of the third compound wheel, with the lug on the active wheel of the second compound wheel and the lug on the third compound wheel being able to be relatively displaced in their respective differential holes, thus achieving differential drive with their respective passive sector wheels; and the active wheel of the second compound wheel and the active wheel of the third compound wheel, while rotating differently compared with their respective passive sector wheels, are each capable of sending a mechanical trigger acting on a clutch frame of a respective linkage wheel to separate the respective linkage wheel; the active wheel of the second compound wheel and the active wheel of the third compound wheel, after differential rotation relative to their respective passive wheels, are in linkage with their respective passive sector wheels which then engage and are in linkage with the respective drive ratchets of respective counter wheels.

8. The coin deposit and summation device according to claim 7, wherein the linkage wheels between the adjacent counter wheels are each mounted on a respective clutch frame, with each clutch frame positioned by art elastic member; the active wheel of the second compound wheel controls the clutch frame to which the linkage wheel between the counter wheels for ones and tens positions corresponds, and the active wheel of the third compound wheel controls the clutch frame to which the linkage wheel between the counter wheels for tens and hundreds positions corresponds, so that the linkage wheel between the counter wheels for ones and tens positions and the linkage wheel between the tens and hundreds positions are able to be separated from their corresponding counter wheels to avoid interference of the counter wheels of ones and tens positions respectively.

9. The coin deposit and summation device according to claim 8, wherein each clutch frame is provided with a positioning elastic sheet, one end of which acts on a tooth position of the linkage wheel; the coin denomination summation mechanism also comprises a one-way clipping spring leaf, whose spring leaf cooperates in positioning with the count linkage teeth on the right periphery of each of the counter wheels.

10. The coin deposit and summation device according to claim 7, wherein an upper cover plate is provided above the sorting gate, the upper cover plate is provided with blocking gates corresponding to the blocking gates of the sorting gate so that the mover is subject to a force symmetrically; the coin denomination identification mechanism and the coin denomination summation mechanism are disposed on a chassis.

* * * * *